US010182672B2

(12) United States Patent
Nicholai

(10) Patent No.: US 10,182,672 B2
(45) Date of Patent: Jan. 22, 2019

(54) WARMING BAG AND SNOW SUIT COMBINATION

(71) Applicant: Robert Nicholai, Togiak, AK (US)

(72) Inventor: Robert Nicholai, Togiak, AK (US)

( * ) Notice: Subject to any disclaimer, the term of this patent is extended or adjusted under 35 U.S.C. 154(b) by 190 days.

(21) Appl. No.: 15/278,312

(22) Filed: Sep. 28, 2016

(65) Prior Publication Data

US 2018/0084843 A1 Mar. 29, 2018

(51) Int. Cl.

| | |
|---|---|
| ***A47G 9/00*** | (2006.01) |
| ***A47G 9/08*** | (2006.01) |
| ***A41D 13/02*** | (2006.01) |
| ***A45F 4/08*** | (2006.01) |
| ***A45F 3/04*** | (2006.01) |

(52) U.S. Cl.

CPC ..... *A47G 9/086* (2013.01); *A41D 13/02* (2013.01); *A45F 3/04* (2013.01); *A45F 4/08* (2013.01); *A41D 2200/20* (2013.01); *A41D 2400/10* (2013.01)

(58) Field of Classification Search

CPC ..... A41D 13/0002; A41D 13/02; A41D 3/00; A47G 9/086; A45F 3/14

See application file for complete search history.

(56) References Cited

U.S. PATENT DOCUMENTS 2,324,665 A * 7/1943 Oathout ..... A41B 13/06 2/69.5
4,466,124 A * 8/1984 Kirkham, Jr. ..... A45F 3/04 224/153
4,483,380 A * 11/1984 Beran ..... A45C 3/00 206/315.1
4,901,897 A * 2/1990 Briggs ..... A45C 3/004 206/287.1
4,989,282 A * 2/1991 Goldstein ..... A47G 9/086 2/69.5
5,673,836 A * 10/1997 Bush ..... A41D 13/00 2/94
6,061,831 A * 5/2000 Rudolph ..... A41D 15/04 2/69
6,243,892 B1 * 6/2001 Kelling ..... A47G 9/086 224/153
6,367,083 B1 * 4/2002 November ..... A47G 9/064 2/69.5
7,058,997 B1 * 6/2006 Klinger ..... A47G 9/086 190/18 A
2001/0025384 A1 * 10/2001 Kester ..... A45F 4/14 2/89
2003/0014802 A1 * 1/2003 Benham ..... A41D 13/02 2/69

(Continued)

*Primary Examiner* — Khaled Annis

(57) ABSTRACT

A warming bag and snow suit combination includes a warming bag having an interior space between the front side and the back side. A slit extends through the front side and extends from a hole in the front side wherein the slit is openable to provide access to the interior space. A slit closure closes the slit. A perimeter closure coupled to the warming bag extends along an edge of the warming bag. The perimeter closure secures the warming bag in a folded position. Each of a pair of straps is coupled to the back side spaced apart for carrying the warming bag in the folded position. A snow suit is provided having a pair of arms, a pair of legs, and a torso section. Each of the arms and the legs is coupled to and extends from the torso section.

8 Claims, 6 Drawing Sheets

(56) References Cited

U.S. PATENT DOCUMENTS

| | | | | |
|---|---|---|---|---|
| 2004/0025929 | A1* | 2/2004 | Turner | E04H 15/38 135/133 |
| 2005/0045674 | A1* | 3/2005 | Rehbein | A47D 13/025 224/160 |
| 2006/0011689 | A1* | 1/2006 | Reid | A45F 3/047 224/637 |
| 2008/0235848 | A1* | 10/2008 | Wilder | A41B 13/06 2/69.5 |
| 2009/0064400 | A1* | 3/2009 | Garrigos | A41D 13/0002 2/458 |
| 2009/0271909 | A1* | 11/2009 | Hegland | A45F 4/12 2/69.5 |
| 2010/0083429 | A1* | 4/2010 | Carraro | A41D 13/02 2/456 |
| 2010/0256716 | A1* | 10/2010 | Haislip | A41D 15/04 607/108 |
| 2011/0023233 | A1* | 2/2011 | Hilgeman, Jr. | A47G 9/086 5/413 R |
| 2012/0227153 | A1* | 9/2012 | Laycock | A41D 27/10 2/88 |
| 2012/0284915 | A1* | 11/2012 | Najari Ehsani | A47G 9/086 5/120 |
| 2012/0297539 | A1* | 11/2012 | Like | A47G 9/086 5/413 R |
| 2012/0318837 | A1* | 12/2012 | Yaeger | A45F 3/06 224/665 |
| 2013/0228600 | A1* | 9/2013 | Teixeira | A45F 4/08 224/156 |

* cited by examiner

WARMING BAG AND SNOW SUIT COMBINATION

BACKGROUND OF THE DISCLOSURE

Field of the Disclosure

The disclosure relates to cold temperature garment devices and more particularly pertains to a new cold temperature garment device for protecting a user from heat loss while alternatively taking part in and resting during cold weather activities.

SUMMARY OF THE DISCLOSURE

An embodiment of the disclosure meets the needs presented above by generally comprising a warming bag having an interior space between the front side and the back side. A slit extends through the front side and extends from a hole in the front side wherein the slit is openable to provide access to the interior space. A slit closure closes the slit. A perimeter closure coupled to the warming bag extends along an edge of the warming bag. The perimeter closure secures the warming bag in a folded position. Each of a pair of straps is coupled to the back side spaced apart for carrying the warming bag in the folded position. A snow suit is provided having a pair of arms, a pair of legs, and a torso section. Each of the arms and the legs is coupled to and extends from the torso section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
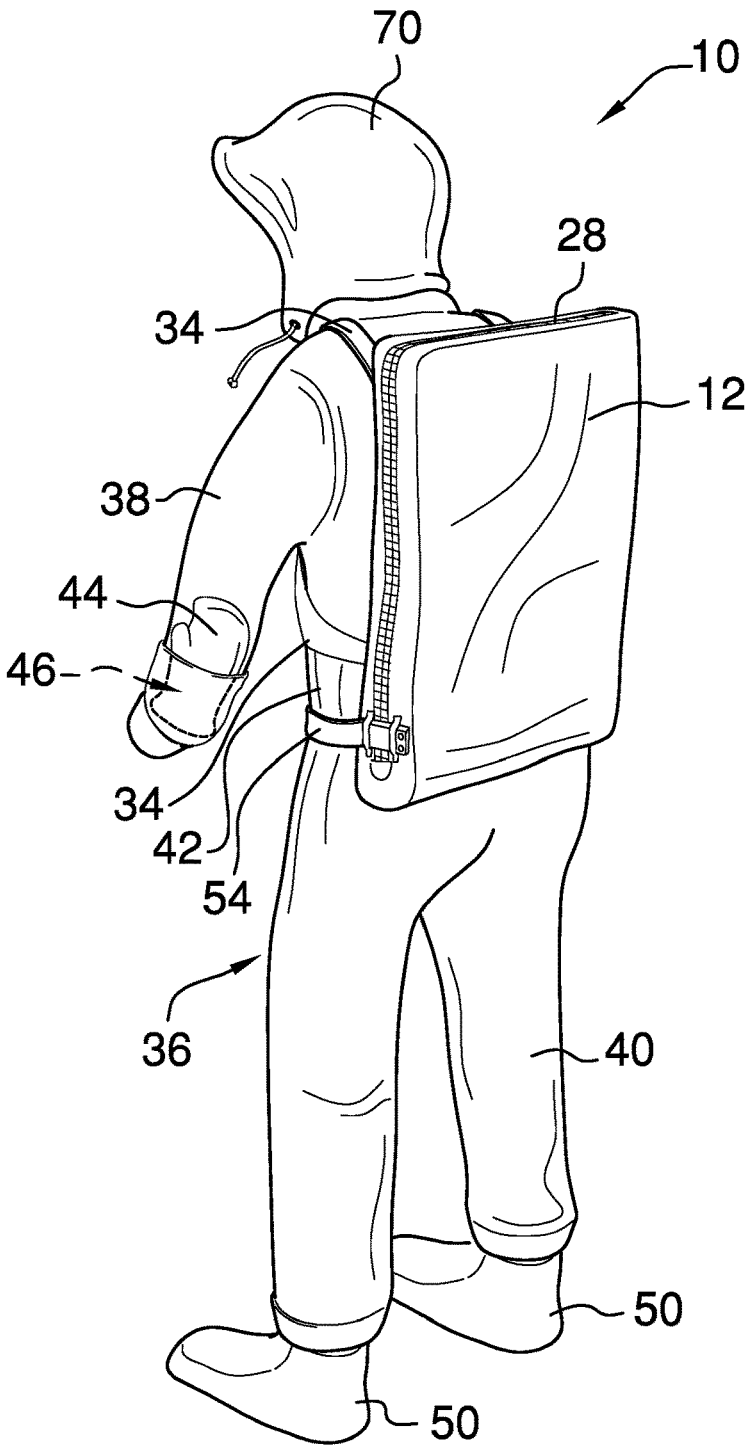
FIG. 1 is a top back side perspective view of a warming bag and snow suit combination according to an embodiment of the disclosure.
Figure 2:
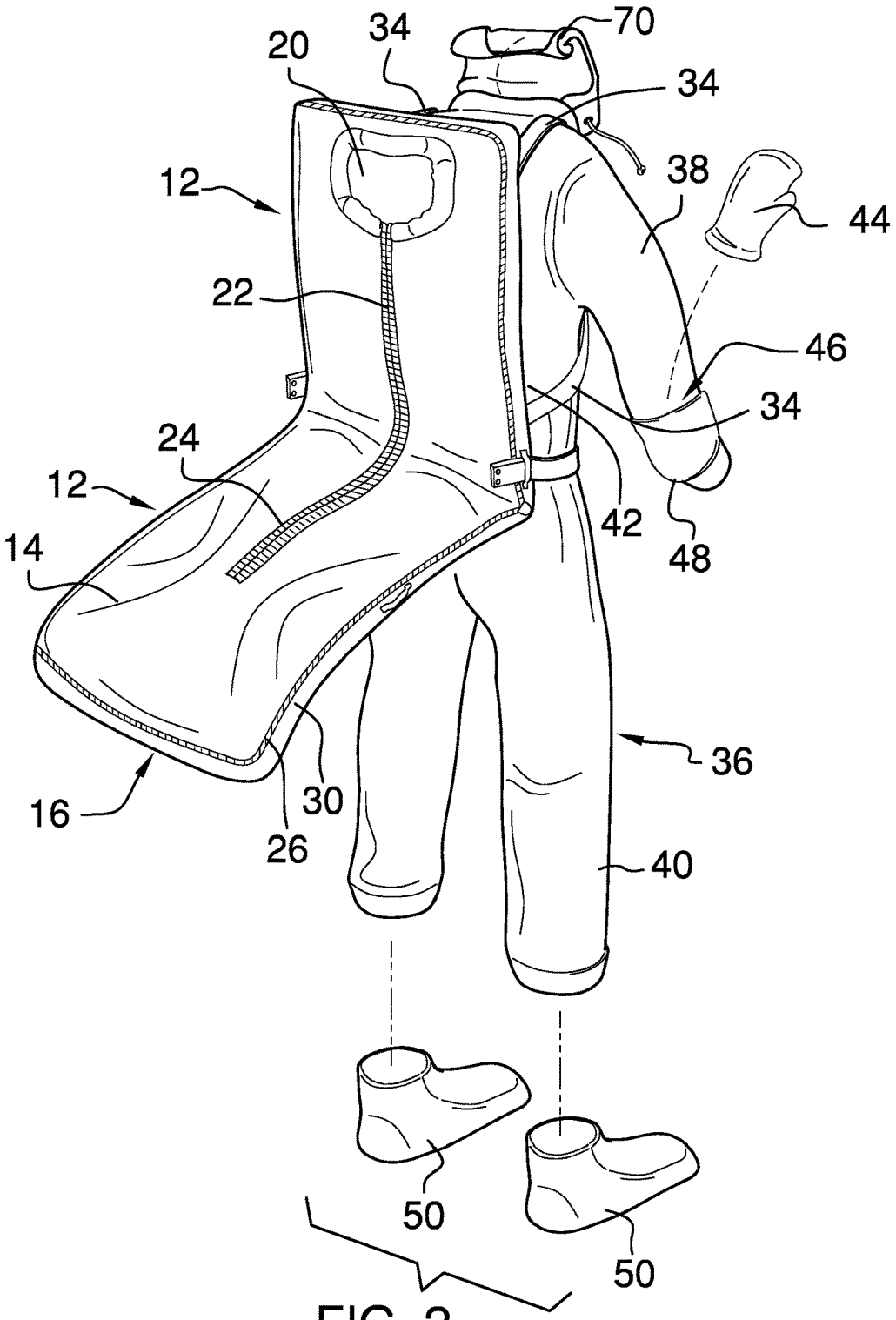
FIG. 2 is a partially exploded top back side perspective view of an embodiment of the disclosure.
Figure 3:
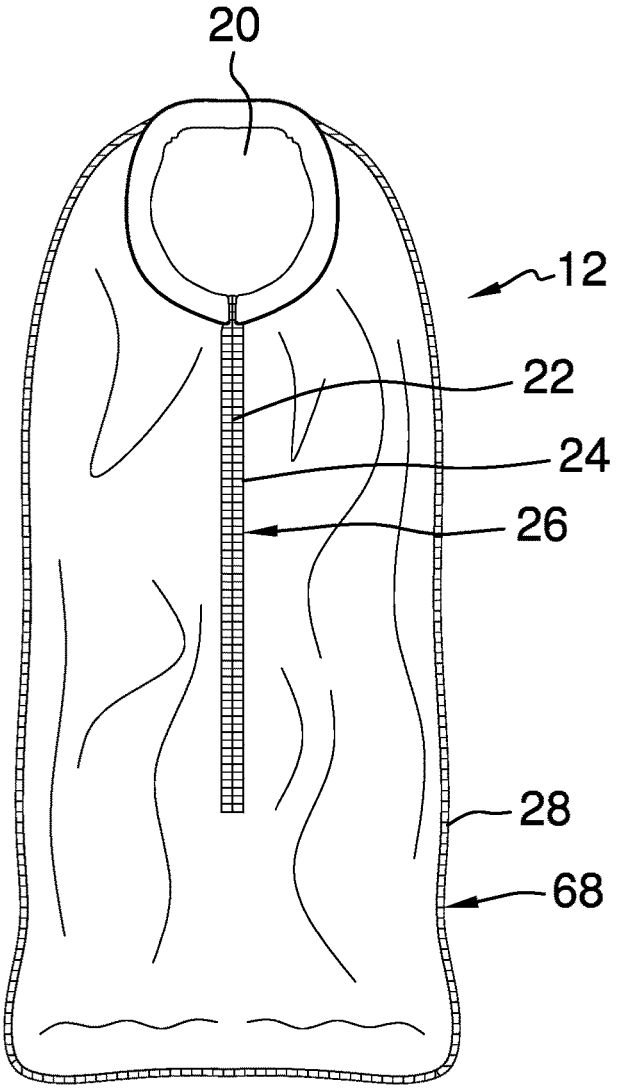
FIG. 3 is a front view of a warming bag of an embodiment of the disclosure.
Figure 4:
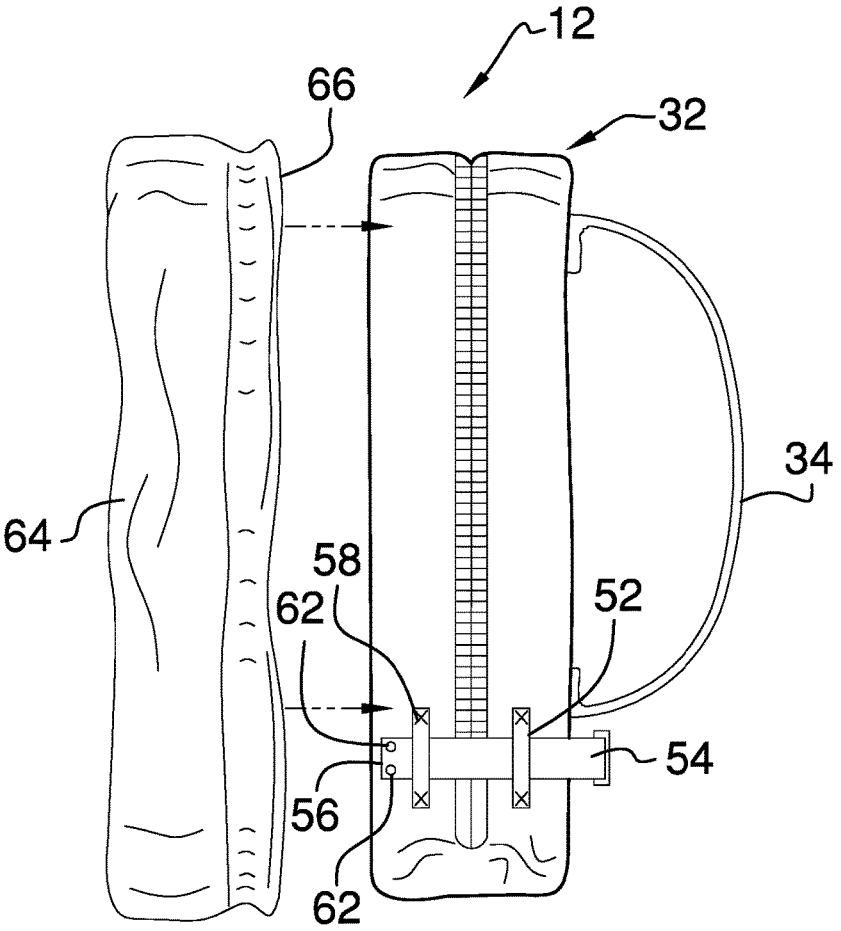
FIG. 4 is a partially exploded view of an embodiment of the disclosure.
Figure 5:
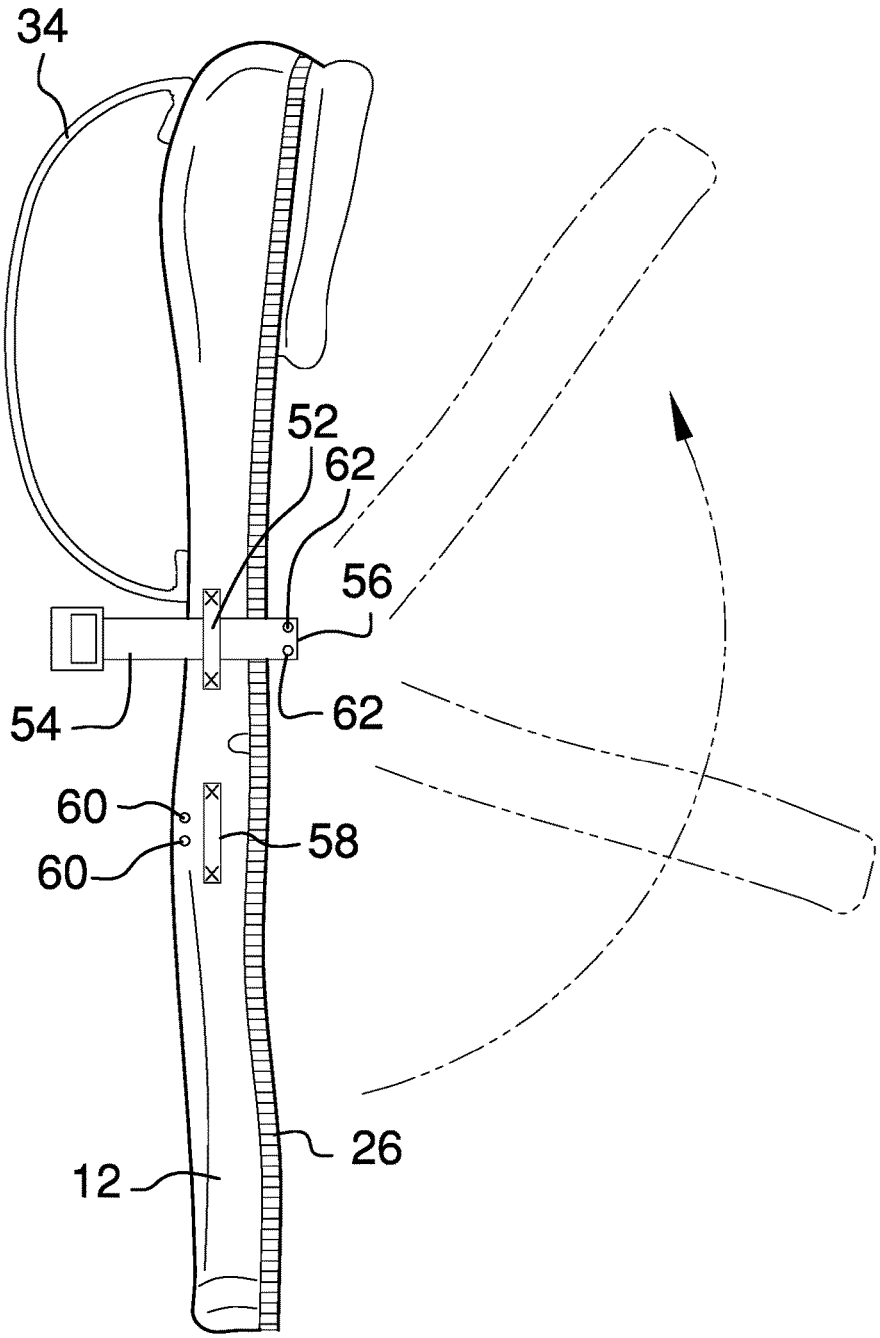
FIG. 5 is a side view of an embodiment of the disclosure.
Figure 6:
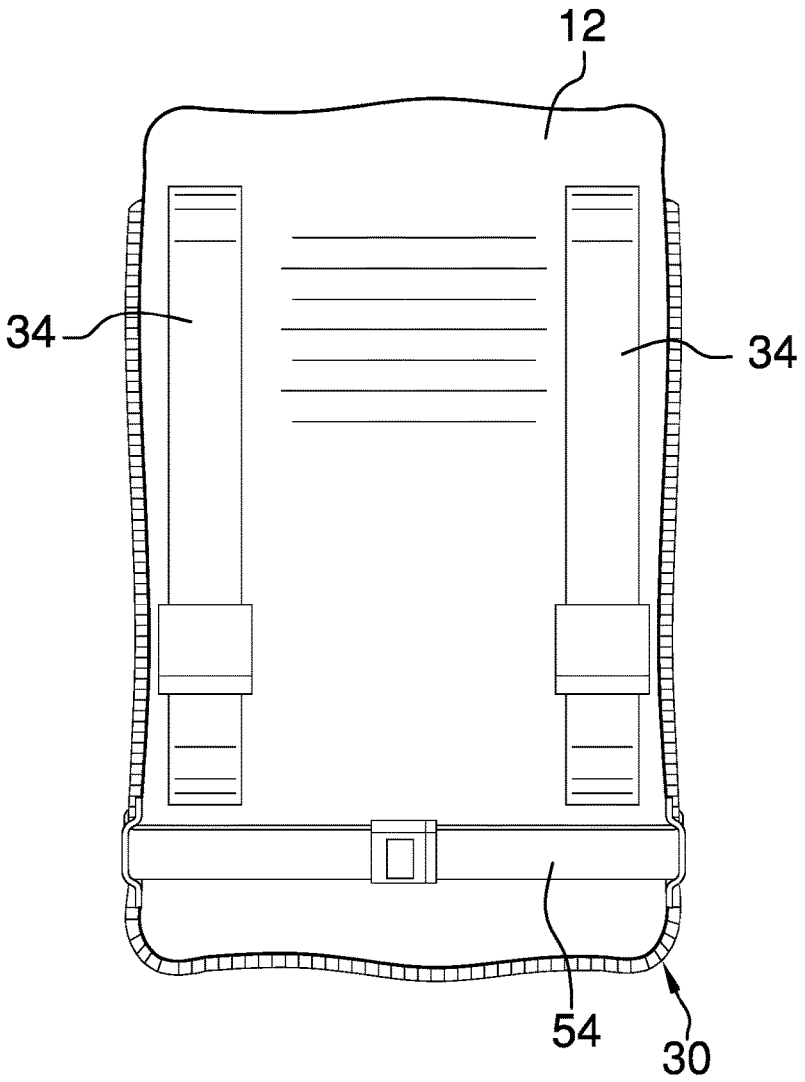
FIG. 6 is a back view of an embodiment of the disclosure.

With reference now to the drawings, and in particular to FIGS. 1 through 6 thereof, a new cold temperature garment device embodying the principles and concepts of an embodiment of the disclosure and generally designated by the reference numeral 10 will be described.

As best illustrated in FIGS. 1 through 6, the warming bag and snow suit combination 10 generally comprises a warming bag 12 having a front side 14, a back side 16 and an interior space 18 between the front side 14 and the back side 16. A hole 20 extends through the front side 14. A slit 22 extends through the front side 14. The slit 22 extends from the hole 20 wherein the slit 22 is openable to provide access to the interior space 18. A slit closure 24 is coupled to the front side 14 to close the slit 22. The slit closure 24 is a first zipper 26. A perimeter closure 28 is coupled to the warming bag 12. The perimeter closure 28 extends along an edge 30 of the warming bag 12 between the front side 14 and the back side 16. The perimeter closure 28 secures the warming bag 12 in a folded position 32 such that the back side 16 faces outwardly and the front side 14 faces inwardly. Each of a pair of straps 34 is coupled to the back side 16. The pair of straps 34 is spaced apart wherein the pair of straps 34 is configured for carrying the warming bag 12 in the folded position 32 by extending the pair of straps 34 over shoulders of the user. A cover 64 may be placed over the warming bag 12 while the warming bag 12 is in the folded position 32. The cover 64 has a gathered open perimeter 66 to extend over and around the warming bag 12 while allowing the straps 34 to be worn by the user.

A snow suit 36 is provided having a pair of arms 38, a pair of legs 40, and a torso section 42. Each of the arms 38 and the legs 40 is coupled to and extends from the torso section 42. A hood 70 is coupled to the torso section 42 of the snow suit 36. Each of a pair of mitten pockets 46 is positioned on an associated one of the arms 38. Each of the mitten pockets 46 is positioned adjacent to a distal end 48 of the associated one of the arms 38 relative to the torso section 42. Each of a pair of mittens 44 is positionable in a respective one of the mitten pockets 46. Each of a pair of thermal socks 50 is positionable within the warming bag 12 with the snow suit 36 in a conventional manner wherein the thermal socks 50 are configured for being worn with the snow suit 36.

Each of a pair of first loops 52 is coupled to the warming bag 12. The first loops 52 are parallel to the perimeter closure 26. A belt 54 has a pair of opposite ends 56. The belt 54 is extendable through the pair of first loops 52. Each of a pair of second loops 58 is coupled to the warming bag 12. The second loops 58 are parallel to the perimeter closure 26. Each of the second loops 58 is laterally aligned with an associated one of the first loops 52 when the perimeter closure 26 secures the warming bag 12 in the folded position 32 wherein the belt 54 is insertable through first loops 52 and the second loops 58.

Each of a pair of base fasteners 60 is coupled to the warming bag 12. Each of the base fasteners 60 is positioned adjacent to an associated one of the second loops 58. The base fasteners 60 are snaps or another conventional fastener. Each of a pair of belt fasteners 62 is complementary and engageable to an associated one of the base fasteners 60 wherein the belt 54 is coupleable to the warming bag 12. The belt fasteners 62 are also snaps or another conventional fastener being complementary to the base fasteners 60.

In use, the snow suit 36 may be stored in the warming bag 12 until ready to be worn. While the snow suit 36 and thermal socks 50 are worn, the warming bag 12 may be worn in the manner of a back pack until needed. When needed, the warming bag 12 may be taken off of the user's back and opened from the folded position 32. The user may enter the warming bag 12 through the slit 22 and the slit closure 24 closed such that the warming bag 12 surrounds the user from the neck down. The warming bag 12 is constructed generally of material for retaining, reflecting, or otherwise conventionally keeping the user warm within the warming bag 12. When sufficiently warmed, the user may quickly and efficiently restore the warming bag 12 to the folded position 32 on the user's back to resume hiking or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A warming bag and snow suit combination device comprising:

a warming bag having a front side, a back side and an interior space between said front side and said back side;

a hole extending through said front side;

a slit extending through said front side, said slit extending from said hole wherein said slit is openable to provide access to said interior space;

a slit closure coupled to said front side, said slit closure closing said slit;

a perimeter closure coupled to said warming bag, said perimeter closure extending along an edge of said warming bag between said front side and said back side, said perimeter closure securing said warming bag in a folded position such that said back side faces outwardly and said front side faces inwardly;

a pair of straps coupled to said back side, said pair of straps being spaced apart wherein said pair of straps is configured for carrying said warming bag in said folded position by extending said pair of straps over shoulders of the user;

a snow suit having a pair of arms, a pair of legs, and a torso section, each of said arms and said legs being coupled to and extending from said torso section; a pair of second loops;

a pair of base fasteners, each of said base fasteners being coupled to said warming bag, each of said base fasteners being positioned adjacent to an associated one of said second loops; and a pair of belt fasteners, each of said belt fasteners being complementary and engageable to an associated one of said base fasteners wherein said belt is coupleable to said warming bag.

2. The device of claim 1, further comprising a hood coupled to said torso section of said snow suit.

3. The device of claim 1, further comprising a pair of mitten pockets, each of said mitten pockets being positioned on an associated one of said arms, each of said mitten pockets being positioned adjacent to a distal end of said associated one of said arms relative to said torso section.

4. The device of claim 1, further comprising a pair of thermal socks, said pair of thermal socks being positionable within said warming bag wherein said thermal socks are configured for being worn with said snow suit.

5. The device of claim 1, further comprising:

a pair of first loops, said first loops being coupled to said warming bag, said first loops being parallel to said perimeter closure; and a belt having a pair of opposite ends, said belt being extendable through said pair of first loops.

6. The device of claim 5, further comprising a pair of second loops, said second loops being coupled to said warming bag, said second loops being parallel to said perimeter closure, each of said second loops being laterally aligned with an associated one of said first loops when said perimeter closure secures said warming bag in said folded position wherein said belt is insertable through first loops and said second loops.

7. The device of claim 1, further comprising said base fasteners and said belt fasteners being snaps.

8. A warming bag and snow suit combination device comprising:

a warming bag having a front side, a back side and an interior space between said front side and said back side;

a hole extending through said front side;

a slit extending through said front side, said slit extending from said hole wherein said slit is openable to provide access to said interior space;

a slit closure coupled to said front side, said slit closure closing said slit;

a perimeter closure coupled to said warming bag, said perimeter closure extending along an edge of said warming bag between said front side and said back side, said perimeter closure securing said warming bag in a folded position such that said back side faces outwardly and said front side faces inwardly;

a pair of straps coupled to said back side, said pair of straps being spaced apart wherein said pair of straps is configured for carrying said warming bag in said folded position by extending said pair of straps over shoulders of the user; and a snow suit having a pair of arms, a pair of legs, and a torso section, each of said arms and said legs being coupled to and extending from said torso section;

a hood coupled to said torso section of said snow suit;

a pair of mitten pockets, each of said mitten pockets being positioned on an associated one of said arms, each of said mitten pockets being positioned adjacent to a distal end of said associated one of said arms relative to said torso section;

a pair of thermal socks, said pair of thermal socks being positionable within said warming bag wherein said thermal socks are configured for being worn with said snow suit;

a pair of first loops, said first loops being coupled to said warming bag, said first loops being parallel to said perimeter closure; and a belt having a pair of opposite ends, said belt being extendable through said pair of first loops;

a pair of second loops, said second loops being coupled to said warming bag, said second loops being parallel to said perimeter closure, each of said second loops being laterally aligned with an associated one of said first loops when said perimeter closure secures said warming bag in said folded position wherein said belt is insertable through first loops and said second loops;

a pair of base fasteners, each of said base fasteners being coupled to said warming bag, each of said base fasteners being positioned adjacent to an associated one of said second loops, said base fasteners being snaps; and a pair of belt fasteners, each of said belt fasteners being complementary and engageable to an associated one of said base fasteners wherein said belt is coupleable to said warming bag, said belt fasteners being snaps.

* * * * *